US008752318B2

(12) United States Patent
Pulit, Jr.

(10) Patent No.: US 8,752,318 B2
(45) Date of Patent: Jun. 17, 2014

(54) MAGAZINE FOR FIREARM

(71) Applicant: Sturm, Ruger & Company, Inc., Southport, CT (US)

(72) Inventor: Charles R. Pulit, Jr., Parkersburg, WV (US)

(73) Assignee: Sturm, Ruger & Company, Inc.

( * ) Notice: Subject to any disclaimer, the term of this patent is extended or adjusted under 35 U.S.C. 154(b) by 0 days.

(21) Appl. No.: 13/708,665

(22) Filed: Dec. 7, 2012

(65) Prior Publication Data

US 2014/0007480 A1 Jan. 9, 2014

Related U.S. Application Data

(60) Provisional application No. 61/568,496, filed on Dec. 8, 2011.

(51) Int. Cl.
*F41A 9/65* (2006.01)

(52) U.S. Cl.
USPC ..... 42/50; 42/49.01; 42/49.02; 42/6; 42/7

(58) Field of Classification Search
USPC ..... 42/49.01, 49.02, 50, 6, 7
See application file for complete search history.

(56) References Cited

U.S. PATENT DOCUMENTS

| | | | | |
|---|---|---|---|---|
| 886,211 | A * | 4/1908 | Hino et al. | 89/139 |
| 3,039,366 | A | 6/1962 | Imthurn et al. | |
| 3,273,275 | A * | 9/1966 | Badali | 42/50 |
| 3,516,189 | A * | 6/1970 | Badali et al. | 42/50 |
| 3,772,812 | A * | 11/1973 | Day | 42/7 |
| 4,139,958 | A * | 2/1979 | Foote | 42/49.02 |
| 4,142,313 | A | 3/1979 | Musgrave | |
| 4,446,645 | A * | 5/1984 | Kelsey et al. | 42/50 |
| 5,379,541 | A * | 1/1995 | Bammate | 42/7 |
| 7,069,683 | B1 * | 7/2006 | Kapusta | 42/70.02 |
| 7,530,191 | B2 * | 5/2009 | Szabo | 42/50 |
| 8,590,203 | B1 * | 11/2013 | McCarthy et al. | 42/96 |
| 2006/0236580 | A1 * | 10/2006 | Szabo | 42/50 |
| 2011/0247482 | A1 * | 10/2011 | Overstreet et al. | 89/138 |
| 2012/0073429 | A1 * | 3/2012 | Bowles et al. | 89/138 |
| 2012/0124879 | A1 * | 5/2012 | Larue | 42/50 |

FOREIGN PATENT DOCUMENTS

DE 7536755 3/1976

OTHER PUBLICATIONS

Smith & Wesson Safety & Instruction Manual, 1911 Series, Jan. 30, 2009, p. 1-44 (relevant portion p. 35), Springfield, MA.

* cited by examiner

*Primary Examiner* — Bret Hayes
*Assistant Examiner* — Derrick Morgan
(74) *Attorney, Agent, or Firm* — The Belles Group, P.C.

(57) ABSTRACT

A magazine for storing and dispensing cartridges to a firearm. In one embodiment, the magazine includes a tubular body, a compression spring, and a two-piece follower including a first follower moveable within the magazine and a second follower disposed below the first follower. The second follower may be movable independently of the first follower and is engaged by the compression spring which applies a biasing force towards an open top end of the magazine. The second follower includes a base plate having an upward extending flange configured and dimensioned for slidable insertion through a slot formed in the first follower. The second follower is operable to project the flange through the slot to contact and assist with ejecting the last spent cartridge case in the magazine. In one embodiment, the firearm may be a pistol.

17 Claims, 7 Drawing Sheets

MAGAZINE FOR FIREARM

CROSS-REFERENCE TO RELATED APPLICATIONS

The present application claims the benefit of priority to U.S. Provisional Application No. 61/568,496 filed Dec. 8, 2011, which is incorporated by reference herein in its entirety.

BACKGROUND OF THE DISCLOSURE

The present disclosure generally relates to firearms, and more particularly to an improved cartridge magazine for a firearm.

Auto-loading firearms generally utilize a magazine for storing and automatically feeding ammunition cartridges or rounds into the firing system. When such firearms are discharged, a cartridge held in the chamber at the rear of the barrel is struck by a firing pin or striker to detonate the charge and propel the bullet or slug down the muzzle. This causes the action to reciprocate rearwards wherein the spent cartridge case or casing is extracted from the chamber and ejected from the firearm. A new cartridge presented by the magazine is then stripped therefrom by return movement of the action and loaded into the chamber in preparation for the next firing cycle.

The last expended case ejection has been a problem since the beginning of auto-loading magazine fed firearm designs. High speed photography has shown that autoloaders consistently eject spent casings by impacting the next round in the magazine more so in some instances than the firearm's ejector mechanism. When no next round is present, such as in the case of an empty magazine, the expended and extracted case upon occasion may slip off the extractor and does not reach the ejector, thereby remaining in the firearm until the magazine is eventually removed for replenishment with new cartridges or is manually shaken out of the action by the user.

A magazine with improved cartridge feed system is desired.

SUMMARY OF THE DISCLOSURE

A magazine for firearms according to embodiments of the present disclosure includes a magazine follower assembly that provides consistent feed and ejection of a last round or cartridge from the firearm in the presence of an empty magazine. In some embodiments, a two-piece follower assembly is provided which includes a first follower and a second follower movable independently of the first follower. The second follower cooperates with, but may otherwise be a separate detached component from first follower. In one embodiment, the second follower is movable from an active projected position in which at least a portion of the second follower protrudes outwards from and beyond the first follower to an inactive retracted position in which the second follower is withdrawn at least partially inside and beneath the first follower in the magazine. In one embodiment, the second follower includes a rigid protrusion such as without limitation an ejection flange which is slidably projected through a slot in the first follower when the second follower is in the projected position. In one embodiment, the firearm may be a pistol.

One advantage of a magazine follower assembly according to the present disclosure is that it simulates having a cartridge or round underneath the last round in the magazine, thereby giving consistent performance similar to the round above the last round, but not sacrificing magazine capacity.

Another advantage of a magazine follower assembly according to the present disclosure is that it provides a shelf for the removal of the last expended case in a magazine fed firearm.

Another advantage of a magazine follower assembly according to the present disclosure is that it may be applied in all types of magazines, single and double column magazines, and to various type magazine fed weapon formats such as pistols and rifles.

Another advantage of a magazine follower assembly according to the present disclosure is the elevation of the last round in the magazine. By supporting the round on or near the same horizontal plane as the chamber, this prevents hollow point and similar type bullets from nose diving into the cartridge feed ramp causing a possible malfunction.

Another advantage of a magazine follower assembly according to the present disclosure is that it also supplies the added benefit of accuracy protection of longer case rounds, by supporting the last round and preventing seat depth change when the bullet is put in a bind with the case when striking the top of the chamber and being dislodged from original seating depth.

Another advantage of a magazine follower assembly according to the present disclosure is a unique design that operates above the level of the magazine body, but does not interfere with the normal cycling of the firearm.

According to one embodiment of the present disclosure, a magazine for storing and dispensing cartridges to a firearm includes an elongated tubular body defining a longitudinal axis and a cavity configured for receiving cartridges, a compression spring disposed in the cavity, a first follower moveable within the cavity, and a second follower disposed within the cavity below the first follower and being movable independently of the first follower. This second follower is urged in an upward direction along the longitudinal axis by the compression spring and has a base plate with an upward extending rigid ejection flange configured and dimensioned for insertion through a slot formed in the first follower. The second follower is moveable from a lower retracted position in which the flange does not project beyond the slot and an upper projected position in which the flange projects above the slot to engage a spent cartridge case being ejected from the firearm. In one embodiment, when the second follower is in the lower retracted position, the base plate is spaced vertically apart from the first follower, and when the second follower is in the projected position, the base plate engages the first follower. In one embodiment, the firearm may be a pistol.

According to another embodiment of the present disclosure, a magazine for storing and dispensing cartridges to a firearm is provided. The magazine includes an elongated tubular body defining a longitudinal axis and having a front wall, a rear wall, and two opposing sidewalls defining a cavity configured for receiving cartridges, a compression spring disposed in the cavity, a first follower slidably moveable within the cavity along the longitudinal axis, and a second follower disposed below the first follower and being movable independently of the first follower. The second follower is urged in an upward direction by the compression spring and has a base plate with an upward extending rigid ejection flange configured and dimensioned for insertion through a slot formed in the first follower. The flange has a forward facing vertical contact surface configured for engaging an extracted spent cartridge case or rim and a rearward facing vertical contact surface configured for engaging a rear surface of the slot. The second follower is moveable from a lower retracted position in which the flange does not project beyond the slot and an upper projected position in which the flange projects above the slot.

According to another embodiment of the present disclosure, a magazine for storing and dispensing cartridges to a firearm includes an elongated tubular body defining a longitudinal axis and having a front wall, a rear wall, and two opposing sidewalls defining a cavity configured for receiving cartridges, a compression spring disposed in the cavity, a first follower slidably moveable within the cavity along the longitudinal axis, the first follower comprising a cartridge support plate including an upper rear part configured for supporting a cartridge case and a lower front part that lies on a different plane than the upper rear part, and a second follower disposed below the first follower and being movable independently of the first follower. The second follower is urged in an upward direction by the compression spring and has a base plate with an upward extending rigid ejection flange configured and dimensioned for slidable insertion through a slot formed in the cartridge support plate of the first follower. The flange has a forward facing vertical contact surface configured for engaging an extracted spent cartridge case or rim and a rearward facing vertical contact surface configured for engaging a rear surface of the slot. The second follower is moveable from a lower retracted position in which the flange does not project beyond the slot and an upper projected position in which the flange projects above the slot. In one embodiment, when the forward facing vertical contact surface engages a spent cartridge case, the rearward facing vertical contact surface engages the rear surface of the slot.

A firearm with magazine for storing and dispensing cartridges is also disclosed. In one embodiment, the firearm includes a frame, a slide slidably mounted on the firearm for forward and rearward reciprocating axial movement, the slide forming an openable and breech face, a barrel supported by the frame and including a chamber configured for holding a cartridge, the barrel defining a cartridge extraction pathway between the chamber and the breech face of the slide, and a magazine. The magazine includes an elongated tubular body defining a longitudinal axis and a cavity configured for receiving cartridges, a compression spring disposed in the cavity, a first follower moveable within the cavity, and a second follower disposed within the cavity below the first follower and being movable independently of the first follower. The second follower is urged in an upward direction along the longitudinal axis of the magazine by the compression spring and has a base plate with an upward extending rigid ejection flange configured and dimensioned for slidable insertion through a slot formed in the first follower. The second follower is moveable from a lower retracted position in which the flange does not project beyond the slot and an upper projected position in which the flange projects above the slot into the cartridge extraction pathway to contact and engage a spent cartridge case extracted from the chamber for ejection from the firearm. In one embodiment, the firearm may be a pistol.

A method for ejecting a cartridge from a firearm is also provided. In one embodiment, the method includes: inserting a magazine containing at least one cartridge into a firearm, the magazine having a two-piece follower assembly including a first follower and a second follower movable independently of the first follower in the magazine; loading the at least one cartridge into a chamber in a barrel of the firearm, wherein the at least one cartridge is a last cartridge in the magazine; projecting an upright flange on the second follower through a slot in the first follower; positioning the flange so that at least a portion of the flange extends into a longitudinally-extending cartridge extraction pathway; discharging the firearm; extracting the cartridge from the chamber; and striking flange with extracted cartridge for ejection from the firearm. In one embodiment, the barrel and chamber defines the cartridge extraction pathway.

BRIEF DESCRIPTION OF THE DRAWINGS

The features of the exemplary embodiments will be described with reference to the following drawings where like elements are labeled similarly, and in which.

Figure 1:
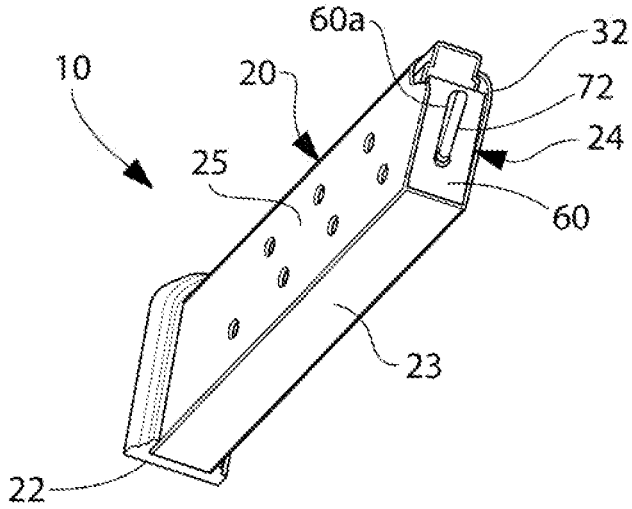
FIGS. 1 and 2 are perspective views of a magazine and two-piece follower according to one embodiment of the present disclosure having a first follower and second follower.
Figure 2:
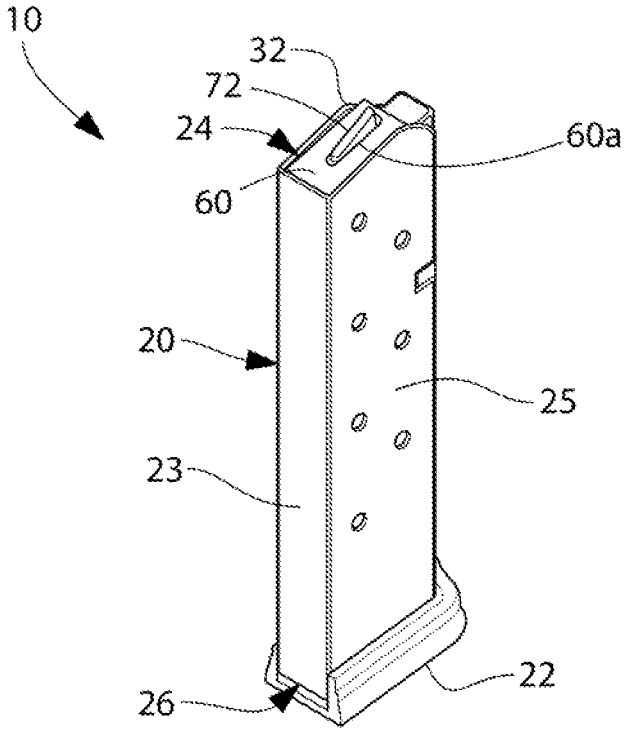

All drawings are schematic and not necessarily to scale.

DESCRIPTION OF EXEMPLARY EMBODIMENTS

The features and benefits of the invention are illustrated and described herein by reference to exemplary embodiments. This description of exemplary embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly." etc.) should be construed to refer to the orientation as then described or as shown in the drawing under discussion. These relative terms are for convenience of description only and do not require that the apparatus be constructed or operated in a particular orientation. Terms such as "attached," "affixed," "connected," and "interconnected," refer to a relationship wherein structures are secured or attached to one another either directly or indirectly through intervening structures, as well as both movable or rigid attachments or relationships, unless expressly described otherwise. The terms "round" and "cartridge" are used interchangeably herein to refer to an ammunition cartridge. Accordingly, the disclosure expressly should not be limited to the exemplary embodiments disclosed herein illustrating some possible non-limiting combination of features that may exist alone or in other combinations of features.

Figure 3:
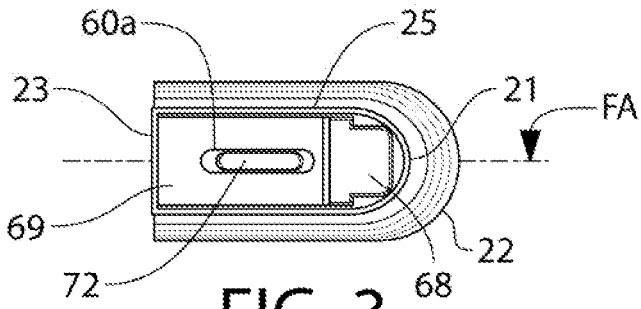
FIG. 3 is a top view thereof.

Referring to FIGS. 1-6, a magazine 10 for a according to the present disclosure includes an elongate hollow tubular body 20 defining a longitudinal axis C aligned with a cartridge feed direction, a base 22, and a follower assembly 30. The body 20 may have an open top end 24 configured for receiving and dispensing cartridges 40 and an opposite open bottom end 26 which may closed by the base which is attached thereto as shown. The tubular body 20 is configured for insertion into a complementary configured magazine cavity or well 82 provided in the firearm, which in various embodiments may be a pistol or rifle. At least a portion of the base 22 typically remains exposed and outboard of the firearm for grasping when the magazine 10 is attached to the firearm. When viewed from the top as shown in FIG. 3 or in transverse cross section, the tubular body is generally elongated in the front to rear direction and includes a front wall 21, rear wall 23, and opposing sidewalls 25. The body 20 defines a cavity 27 configured for storing and dispensing cartridges 40 to the firearm. The distance between the sidewalls 25 is less than the distance between the front and rear walls 21, 23. The tubular body 20 may have any suitable lateral side-to-side width and front-to-back depth which is selected to complement the size of the ammunition cartridges to be stored therein and firearm magazine well 82 (see FIGS. 8 and 9).

In various embodiments, the magazine may be single column or staggered double column type with a body having a suitable lateral width to accommodate either type of arrangement. Either type arrangement is well known in the art.

In some embodiments, the magazine body 20 may be formed of stamped metal. The base 22 may be formed of a suitable material including metal or plastic as commonly used and attached to the bottom end 26 of the magazine via any suitable mechanical attachment means including fasteners, interlocking tabs/slots, adhesives, etc. The base 22 is generally in the form of a flat plate with a width (side-to-side) and depth (front-to-rear) often greater than the magazine body in at least one of width and/or depth.

Figure 4:
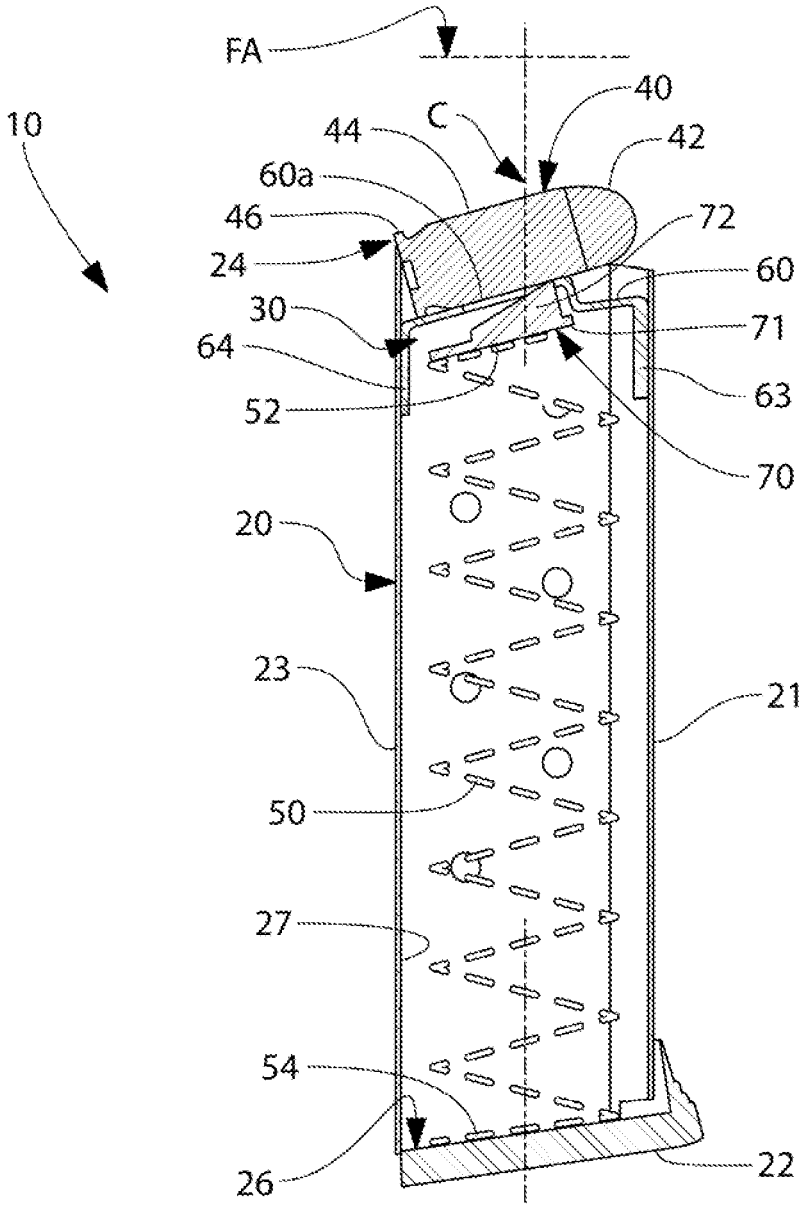
FIG. 4 is a side elevation cross-sectional view thereof showing the second follower in an inactive retracted position.

With continuing reference to FIGS. 1-6, the upper portion of the sidewalls 25 adjacent the open top end 24 of the magazine body 20 in some embodiments (also referred to as lips in the art) may be arranged in a conventional slightly converging relationship to each other projecting inwards toward the longitudinal axis C defined by the length (defined between top and bottom ends 24, 26) of the magazine 10 to retain the spring-biased cartridges 40 in the magazine after being loaded by a user. The opening defined by the inward-turned upper portions or lips 32 of the sidewalls 25 are wide enough to permit only a single cartridge to be fed into the firearm. When positioned in the firearm, the magazine would be oriented with the rounded bullet 42 end of the cartridge 40 facing forwards (i.e. to the right as shown in FIG. 4 towards front wall 21). The front wall 21 of the magazine may be convexly and arcuately rounded to conform to the shape of the cartridge as shown in FIG. 3.

Referring to FIGS. 1-5, the magazine 10 further includes a compression spring 50 and a follower assembly 30 formed according to the present disclosure. The spring 50 has a lower end 54 which engages the base 22 and an upper end 52 which engages the follower assembly. The spring provides an upwards directed biasing force against the follower assembly to urge cartridges 40 towards the open top end 24 of the magazine 10 for automatically feeding ammunition to the firearm. The spring 50 may be any commercially available compression spring commonly used for firearm magazines.

Figure 5:
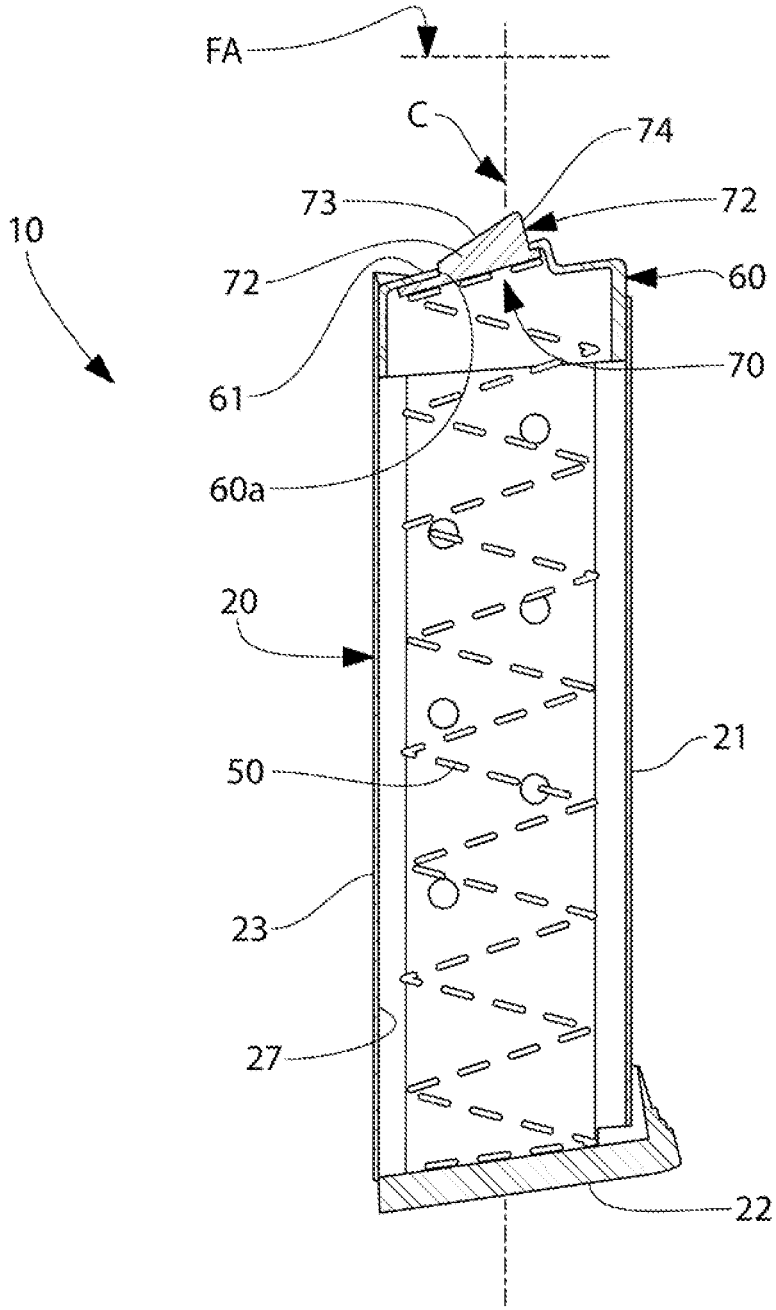
FIG. 5 is a side elevation cross-sectional view thereof showing the second follower in an active projected position.
Figure 6:
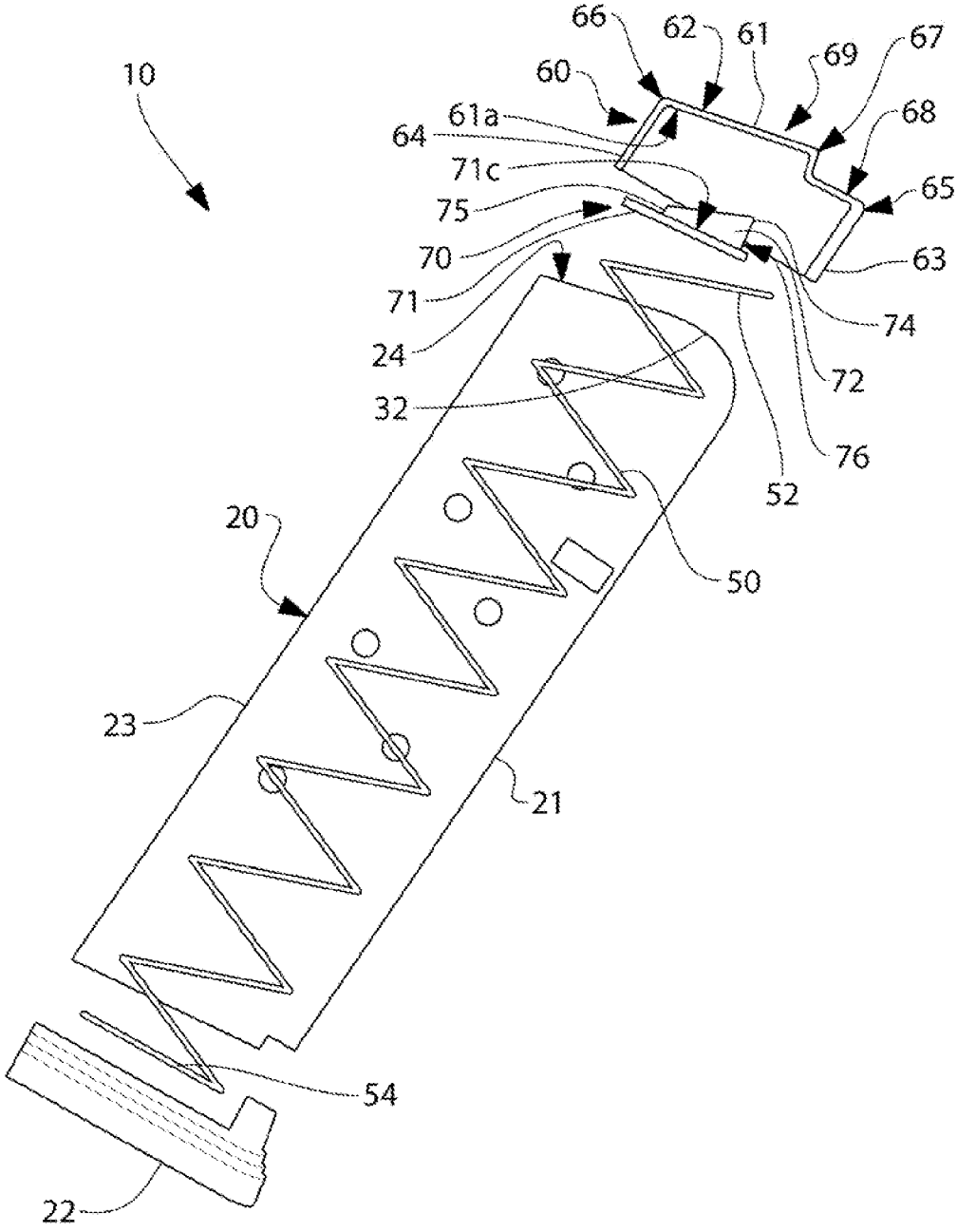
FIG. 6 is an exploded side elevation view of the two-piece follower.

In one embodiment, the follower assembly 30 may be a two-piece assembly including a first primary follower 60 and a second follower 70 which cooperates with the first follower (see, e.g. FIG. 6 showing exploded view of the magazine). The first and second followers 60 70 are separate, discrete components which are moveable independently of each other and not linked together by any integrally formed or physically connected portions. Referring now to FIGS. 1-6, the first follower 60 is configured and dimensioned to be received inside the open magazine tube body 20 for sliding upwards/downwards movement therein in a conventional manner. The first follower 60 may be a substantially rigid structure and includes a cartridge support plate 61 defining a top surface 62 configured for holding the cartridge. In one embodiment, the surface 62 may be substantially flat or planar. A pair of vertical guide extensions 63, 64 depending downwardly from the front and rear ends 65, 66 of the support plate 61 may also be provided (see FIG. 6). The extensions 63, 64 are aligned parallel to the front and rear walls 21, 23 of the magazine body 20 to help guide and produce smooth sliding movement of the first follower 60 within the magazine's tubular body. In some embodiments, as best shown in FIG. 6, the cartridge support plate 61 may have multiple surface levels defined by a step 67 as shown so that a lower front part 68 of the support plate lies on a different plane than an upper rear part 69 of the plate and the front part 68 does not substantially contact the rounded or conical-shaped bullet 42 at the front of the cartridge 40 (see FIG. 5). The rear part 69 of the support plate 61 holds and abuttingly engages the cartridge 40. When viewed from the front to rear transversely, the cartridge support plate 61 may be substantially flat or slightly arcuately rounded from side to side to conform to the shape of the cartridge case. In some embodiments, the cartridge support plate 61 may have an angled shape sloping downwards from front 65 to rear 66 when positioned in the magazine (see FIG. 5). It will be appreciated that the support plate 61 may have any suitable configuration so long as the cartridge may be adequately supported and uploaded into the firearm and chamber.

Referring to FIGS. 1-5, the second follower 70 is positioned below the first follower 60 and is movable independently with respect to the first follower. The second follower 70 includes a substantially flat horizontal base plate 71 and a rigid vertical cartridge-engaging ejection flange 72 projecting upwards from the base. The ejection flange 72 may be disposed generally perpendicular to the base 71 as shown. Preferably, flange 72 is rigidly structured and fixedly connected to or formed as an integral unitary structural pan of the base plate 71 so that there is no substantial relative flexible or resilient movement between the flange and base plate.

It should be noted that the preferred rigid structuring of flange 72 ensures that the flange when in the upper projected position (see, e.g. FIGS. 5 and 9) can both structurally withstand the impact force from being struck by an extracted spent cartridge case 44 without failure and can maintain its projected position relative to first follower 60 to provide positive ejection of the spent case out of the firearm. Accordingly, flange 72 is preferably not flexible to the extent that would compromise the foregoing desired functionality of the second follower 70 to assist with ejecting a spent cartridge case.

In some embodiments, referring to FIG. 6, the flange 72 may have a sloped top 73 from forward facing front 74 to rearward facing rear 75 with the front being higher than the rear of the flange as shown. The forward facing front 74 of the flange defines a forward facing vertical contact surface 76 for engaging an extracted spent cartridge case 44 and/or rim 46 to assist with ejecting the spent case of the last round from the firearm in the absence of any remaining rounds in the magazine 10. When flange 72 is in the upper projected position (see FIG. 5), the vertical contact surface 76 is disposed generally perpendicular to cartridge support plate 61 in one embodiment. The rearward facing rear 75 defines a second rearward facing vertical contact surface 77 for engaging a forward facing rear surface 60*b* of slot 60*a* to horizontally and structurally brace the flange 74 for impact when an extracted spent cartridge case 44 and/or rim 46 strikes the opposing forward facing contact surface 76 of flange 72 to assist with positive ejection of the spent case. Rear 75 with rearward facing vertical contact surface 77 accordingly are unattached to and slidable with respect to forward facing rear surface 60*b* of slot 60*a*. An angular notch (e.g. 90 degrees in one embodiment) is formed between vertical contact surface 77 and generally horizontal top surface 71*c* of base plate 71 of the second follower 70 (see FIGS. 5-7) to firmly seat flange 72 against the rear surface 60*b* of slot 60 when struck by the spent cartridge case and/or rim during cartridge ejection from the firearm.

In some embodiments, the top 52 of the compression spring 50 acts on the bottom of the second follower 70 such as on the underside of base plate 71 as shown in FIG. 4, which in turn acts on the first follower 60 via contact between the first and second followers. In one preferred embodiment, the spring 50 acts solely on the second follower 70 and does not engage the first follower 60 to ensure that the second follower is biased upwards towards the top end 24 of magazine 10 entirely independently of first follower. This arrangement directs the entire biasing force of spring 50 against the second follower 70 to positively and reliably cause the projection of upstanding flange 72 through slot 60*a* in the first follower 60 for intercepting an extracted cartridge case 44, as described herein. The biasing force of the spring 50 urges the first and second follower upwards in the magazine.

The flange 72 on the second follower 70 may be automatically projected and retracted through a complementary configured and dimensioned elongated slot 60*a* (see FIG. 3) provided in the first follower 60 by compression spring 50. The slot 60*a* is formed in the cartridge support plate 61 of the first follower 60 and has a greater length L1 than width W1, as shown in FIGS. 1-3 and 7. In some embodiments, the slot 60*a* is formed in the upper rear raised part 69 of the cartridge support plate 61 of the first follower 60 (see also FIG. 6). Slot 60*a* extends completely through the support plate 61 in a preferred embodiment to receive flange 72 through the slot.

Figure 7:
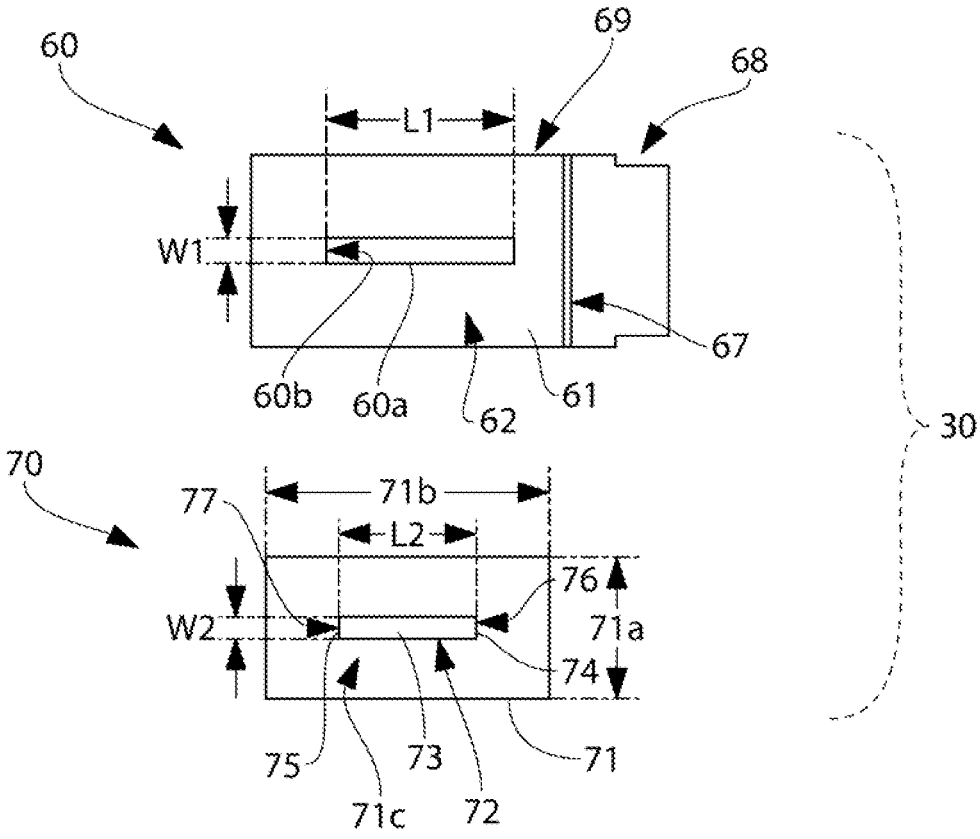
FIG. 7 is a top plan view of the two-piece follower in an exploded disassembled condition.

As shown in FIG. 7, flange 72 has at least a length L2 and/or a width W2 that are dimensioned slightly smaller than the corresponding length L1 and/or width W1 of the slot 60*a* to allow the flange to be projected upwards through the slot when deployed in the projected position as shown in FIG. 5. Flange 72 and slot 60*a* are elongated in the direction of a firing axis FA (shown in FIGS. 3-5) which is oriented transversely to the longitudinal axis C of magazine 10. Firing axis FA is defined as extending through the front and rear walls 21, 23 of magazine 10 and perpendicular to longitudinal axis C. Flange 72 has a height measured along the longitudinal axis C at front 74 that is larger than the width W2 in one embodiment (see FIGS. 6 and 7).

FIG. 7 is a top plan view of follower assembly 30 including the first follower 60 and second follower 70. Base plate 71 of the second follower 70 preferably has at least a width 71*a* or length 71*b* that is larger than the length 60*b* or width 60*c* of slot 60*a* in the cartridge support plate 61. In one embodiment, both the width 71*a* and length 71*b* of base plate 71 are larger than the length L1 and width W1 of slot 60*a*. This geometric arrangement and dimensions are desired to prevent the second follower from being ejected upwards completely through slot 60*a* of the first follower under the biasing force of spring 50.

The top surface 71*c* of base plate 71 (best shown in FIG. 6) will normally engage the bottom surface 61*a* of cartridge support plate 61 under the biasing force of spring 50 when the follower assembly 30 is installed in the magazine 10 and there are no cartridges 40 remaining so that the flange 72 is in the upper projected position, as shown in FIG. 5. The rearward facing surface 77 of flange 72 is positioned to engage the forward facing surface 60*b* of slot 60*a* (see, e.g. FIGS. 3 and 5) when the flange is struck by an ejected spent cartridge case 44 and/or rim 46 when there is at least one cartridge 40 remaining in the magazine 10, the top surface 71*c* of base plate 71 will be vertically spaced apart from bottom surface 61*a* of cartridge support plate 61 by a distance so that the flange 72 is in the lower retracted position, as shown in FIG. 4. As shown in FIG. 4, the entire base plate 71 of the second follower 70 is spaced apart from the cartridge support plate 61 of the first follower 60.

In operation, the second follower 70 is movable independently of and with respect to the first follower 60 between a retracted lower position (see, e.g. FIG. 4) and an upper projected position (see, e.g. FIG. 5), as further described below.

Figure 8:
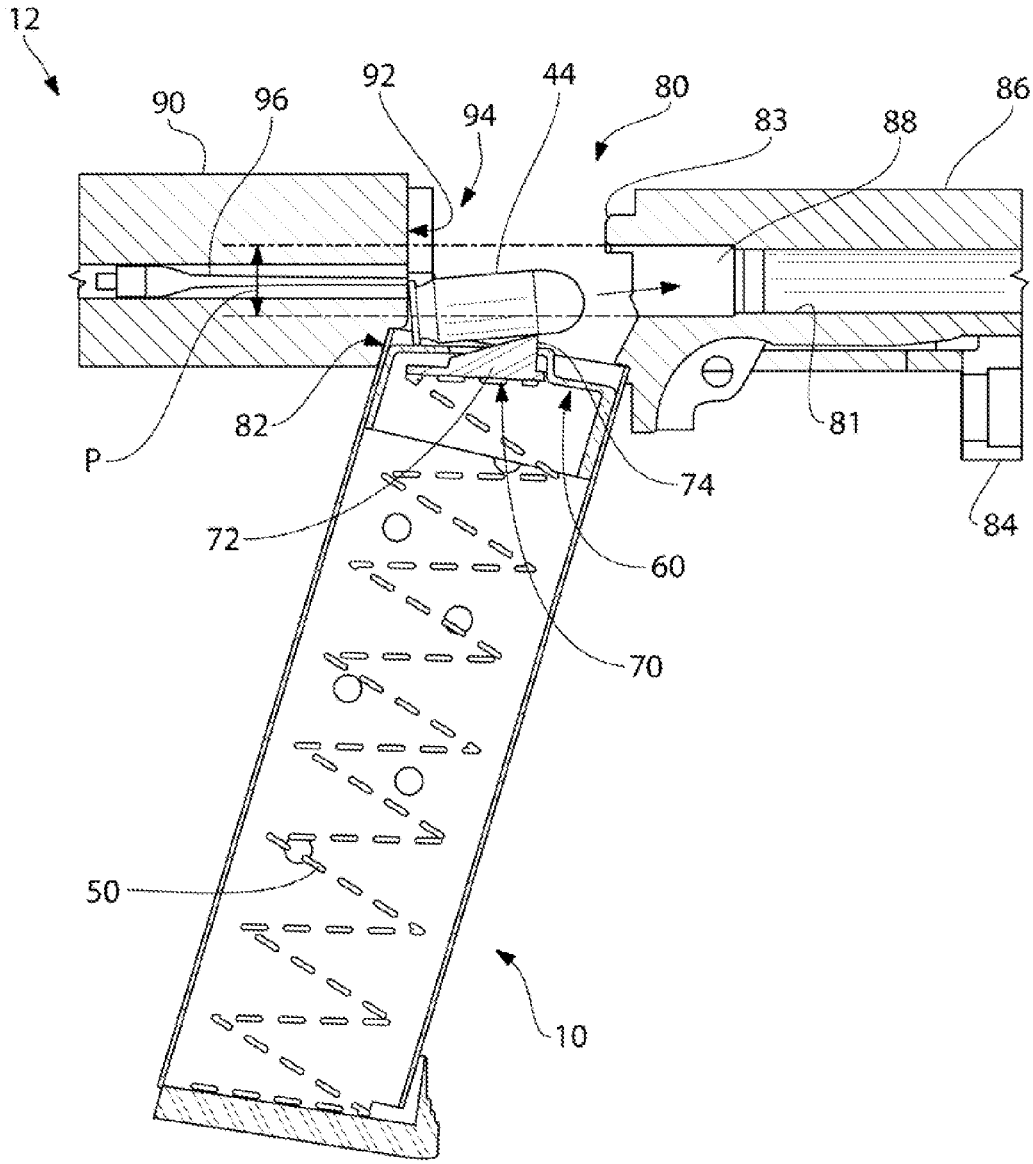
FIG. 8 is a partial side elevation cross-sectional view of the breech area of a pistol showing the magazine installed therein with the second follower in the inactive retracted position of FIG. 4.
Figure 9:
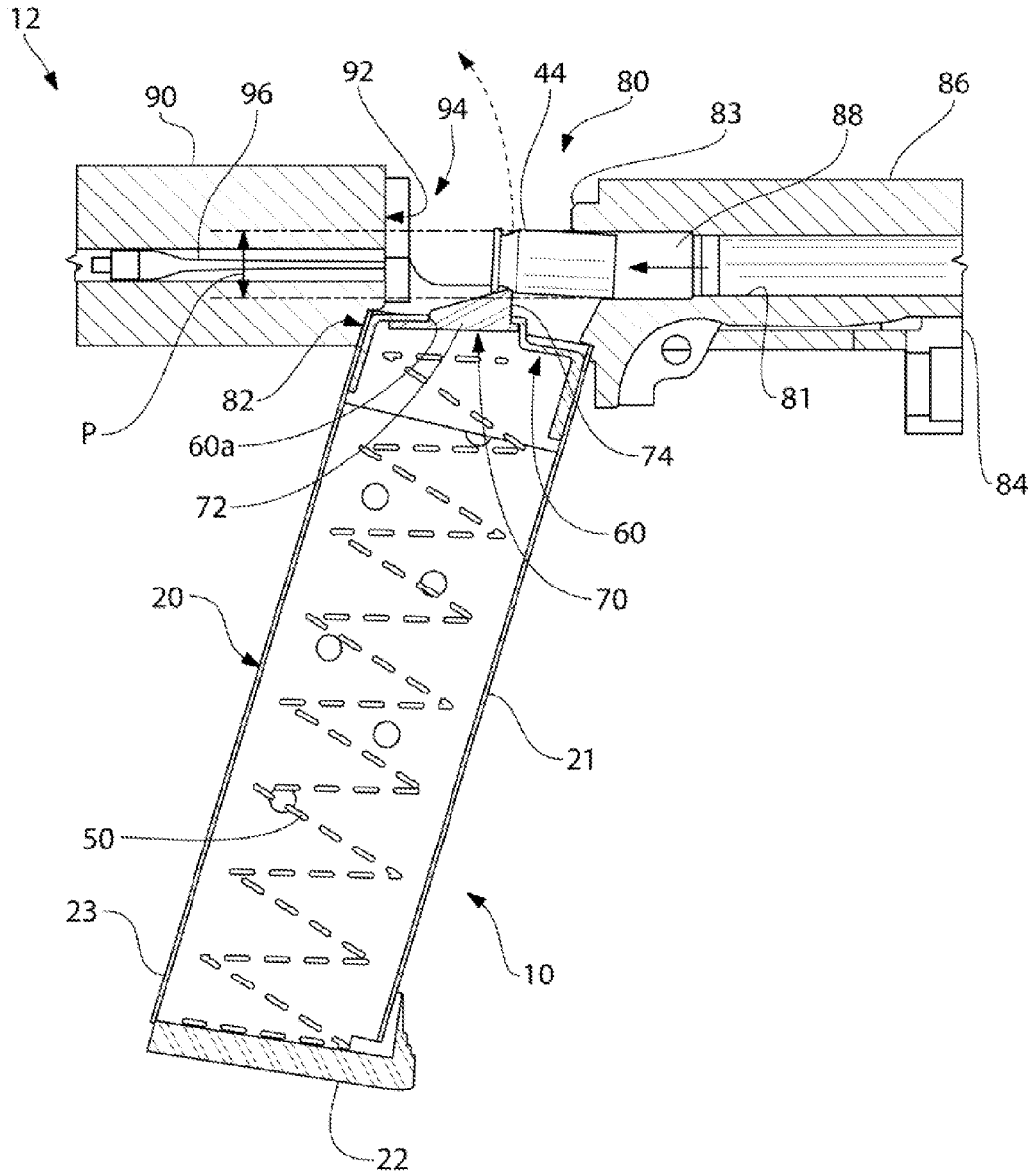
FIG. 9 is a partial side elevation cross-sectional view of the breech area of a pistol showing the magazine installed therein with the second follower in the active projected position of FIG. 5 positioned to intercept a spent cartridge case extracted from the barrel chamber.

FIGS. 8 and 9 are partial side elevation cross-sectional views of the breech area 80 of a firearm 12 showing the magazine 10 fully inserted and installed in the magazine well 82 with the second follower 70 in the inactive retracted position and active projected position, respectively. In one embodiment, the firearm 12 may be a pistol. Firearm 12 is shown to further include a frame 84, a barrel 86 with chamber 88 at the rear breech end 83 (opposite the forward muzzle end not shown) configured for holding a cartridge 40, and a breech block face 92 formed on a reciprocating slide 90 that is slidably mounted on frame 84 for axial forward and rearward movement as will be well known to those skilled in the art without further elaboration. A striker or firing pin 96 is slidably disposed in slide 90 as shown which can be projected through an opening in the breech block face 92 to strike and detonated cartridge 40 in the usual manner. The breech block face 92 is movable rearward with the slide 90 for forming an open breech area 80 as shown in FIGS. 8 and 9 in which the breech block face 92 is spaced axially apart from the rear open end 83 of chamber 88, and further movable forward into battery with the chamber 88 for forming a closed breech area 80 (not shown) in which the breech block face is located proximate to and/or engaging portions of the rear end of chamber 88 (with a head space allowance to accommodate the cartridge rim 46 in some embodiments). The open breech area 80 shown in FIGS. 8 and 9 would occur during either loading a new cartridge 40 into chamber 88 from magazine 10 or extracting a spent cartridge case 44 from the chamber after discharging the firearm 12.

With continuing reference to FIGS. 8 and 9, the barrel 86 includes an axial bore 81 that communicates with chamber 88 for receiving bullet 42 therethrough upon discharging the firearm 12. The barrel bore 81 and adjoining chamber 88 define a firing axis which concentrically coincides with a longitudinally-extending cartridge extraction pathway P defined rear of the chamber 88 in breech area 80 between breech block face 92 and rear breech end 83 of the chamber. Pathway P is the path along which a spent cartridge case 44 automatically extracted from the chamber 88 would travel rearwards after discharging firearm 12 to be ejected. The cartridge extraction pathway P is essentially bounded at the top and bottom by the vertical distance between the top and bottom of the open rear end 83 of chamber 88 as represented by the dashed lines in FIGS. 8 and 9.

An exemplary method for operating magazine 10 will now be described with reference to firearm 12 shown in FIGS. 8 and 9.

FIG. 8 shows a cartridge 40 positioned for automatic dispensing from magazine 10 by spring 50 and insertion forward into the barrel chamber 88 (see directional arrow). During normal functioning of the follower assembly 30 when at least one round or cartridge 40 remains in the magazine, the second follower 70 remains in the retracted position shown in FIGS. 4 and 8. The cartridge 40 holds the second follower 70 in this retracted lower position against the upward biasing force of the compression spring 50. The cartridge 40 is in turn retained in the magazine 10 against the spring force by the inward-turned curved lips 32 at the top of the magazine in the usual manner. When the firearm 12 is discharged, the presence of a next cartridge 40 (e.g. at least one remaining) presented by the magazine 10 as shown in FIGS. 4 and 8 assists with contacting and ejecting the extracted spent case 44 from the firearm chamber because at least a portion of the remaining cartridge (e.g. bullet 42) will be positioned to intercept at least a portion of the extracted cartridge case 44 and/or rim 46. The spent case 44 will generally strike the remaining cartridge 40 and rotate causing it to be ejected upwards through the open breech and ejection port 94 of the firearm. This action supplements the firearm's ejector mechanism to ensure positive ejection of the spent case 44 from the firearm.

It should be noted for clarification in FIG. 8 that flange 72 of second follower 70 is shown as having started to emerge from slot 60*a* of first follower 60 as the cartridge case 44 starts to disengage cartridge support plate 61 upon being uploaded into chamber 88 because this is the last round in magazine 10.

After the last cartridge 40 has been chambered and fired, there no longer remains any cartridge in the magazine 10 as shown in FIGS. 1-3, 5, and 9. Without a remaining cartridge in the magazine, the spring 50 is able to force the second follower 70 fully upward through slot 60*a* in first follower 60 to the projected position best shown in FIGS. 5 and 9. The vertical flange 72 on the second follower 70 emerges from the slot 60*a* in the first follower 60 and protrudes upwards from the first follower 60 beyond top surface 62 by a vertical distance that is sufficient to simulate the presence of a cartridge 40 (see FIGS. 5 and 9). FIG. 9 shows flange 72 in the fully extended or projected position. In this embodiment, at least part of the top 73 and front 74 of flange 72 is raised and protrudes by a vertical distance above the upper rear part 69 and top surface 62 of the cartridge support plate 61. The forward facing contact surface 76 on front 74 and uppermost top leading edge or corner of flange 72 at the top of the forward facing front 74 (between front contact surface 76 and top 73) therefore assumes the same general position as a portion of the front end of the cartridge 40 such as the bullet 42 normally would (compare with FIGS. 4 and 8).

In one embodiment, with reference to FIG. 9, a portion of front contact surface 76 of flange 72 is projected into cartridge extraction pathway P as shown and positioned above the front end 65 of the cartridge support plate 61 as shown in FIGS. 5 and 9 to make positive contact with the extracted spent cartridge case 44 and/or rim 46 of cartridge 40. When the firearm 12 is discharged, the extracted last round spent case 44 (i.e. without bullet 42 which has exited forward through barrel bore 81) that is removed rearward from the barrel chamber 88 by the extractor (see directional arrow in FIG. 9) will encounter and contact the flange 72 of the second follower 70, which advantageously acts as a secondary or backup firearm ejector that assists with reliably ejecting the spent cartridge case 44 through ejector port 94 of the firearm 12 (see dashed directional arrow). The second follower 70 accordingly acts as a surrogate for a last remaining round or cartridge 40 when none remains in the magazine 10.

Preferably, the upright flange 72 on the second follower 70 is projected through slot 60*a* in the first follower by a vertical distance sufficient to position and extend at least a portion of the flange into cartridge extraction pathway P as shown in FIGS. 5 and 9. This will ensure that at least a portion of the spent cartridge case 44 and/or rim will strike flange 72 when extracted rearward from chamber 88 along pathway P. Accordingly, it will be appreciated that the flange 70 need only project above cartridge support plate 61 and top surface 62 of the first follower 60 into pathway P by a distance sufficient to contact the last extracted spent cartridge case 44. The top 73 of the second follower flange 72 (see, e.g. FIG. 6) need not occupy the same total height of bullet 42 at the forward end of the cartridge 40 so long as a portion of the flange is positioned to be struck by at least a portion of the spent cartridge case 44 and/or rim 46 when extracted.

In one embodiment as shown in FIG. 4, base plate 71 and flange 72 of the second follower 70 may be disposed at an angle with respect to the front and rear walls 21, 23. In a firearm such as a pistol, for example, the magazine 10 is generally positioned in the magazine well 82 (see FIGS. 8 and 9) at a slightly forward leaning angle as will be well known to those skilled in the art. The angular positioning of the base plate 71 and flange 72 will orient the forward facing contact surface 76 of flange 72 in a generally vertical position to intercept the spent cartridge case 44 and/or rim 46 when extracted rearwards from the firearm chamber.

The second follower 70 may be made of a durable, impact resistant material to withstand contact forces from an extracted cartridge case striking the follower. For the same reasons, the second follower 70 is preferably rigid and inflexible in construction for impact resistance. In some embodiments, the second follower 70 may be made of metal such as without limitation aluminum, steel, titanium and alloys thereof. In other embodiments, the second follower may be made of a rigid and generally inflexible polymer which may be reinforced or unreinforced with fillers. The first follower 60 may be made of similar materials. In some embodiments, the first follower 60 and second follower 70 may be made of different materials or the same material.

The two-piece follower assembly 30 disclosed herein may be used with equal benefit in virtually any firearm including pistols or rifles that utilize a magazine ammunition feed system. Accordingly, the invention is not limited to handguns alone.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A magazine for storing and dispensing cartridges to a firearm, the magazine comprising:

an elongated tubular body defining a longitudinal axis and a cavity configured for receiving cartridges;

a compression spring disposed in the cavity;

a first follower moveable within the cavity;

a second follower disposed within the cavity below the first follower and being movable independently of the first follower, the second follower urged in an upward direction along the longitudinal axis by the compression spring and having a base plate with an upward extending rigid ejection flange configured and dimensioned for slidable insertion through a slot formed in the first follower;

wherein the second follower is moveable from a lower retracted position in which the flange does not project beyond the slot and an upper projected position in which the flange projects above the slot to engage a spent cartridge case being ejected from the firearm;

wherein the base plate of the second follower has a length and width and the slot of the first follower has a length and width; and wherein both the length and width of the base plate of the second follower are larger than the length and width of the slot of the first follower.

2. The magazine of claim 1, wherein when the second follower is in the lower retracted position, the entire base plate is spaced vertically apart from the first follower, and when the second follower is in the projected position, the base plate engages the first follower.

3. The magazine of claim 1, wherein the flange of the second follower includes a forward facing vertical contact surface configured and positioned to eject the spent case of a last round from the firearm in the absence of any remaining rounds in the magazine when the second follower is in the upper projected position.

4. The magazine of claim 3, wherein the forward facing vertical contact surface is oriented substantially perpendicular to a cartridge support plate of the first follower configured to hold a cartridge case.

5. The magazine of claim 4, wherein flange of the second follower has a sloped top which is higher at a front than a rear of the flange.

6. The magazine of claim 3, wherein the flange of the second follower further includes a rearward facing vertical contact surface operable for engaging a rear surface of slot to brace the flange when an extracted spent cartridge case or rim strikes the opposing forward facing contact surface of flange.

7. The magazine of claim 1, wherein the flange projects substantially above the front end of the first follower when the second follower is in the upper projected position.

8. The magazine of claim 1, wherein the first follower comprises a cartridge support plate including an upper rear part configured for supporting a cartridge case and a lower front part that lies on a different plane than the upper rear part, the slot of the first follower being disposed in the upper rear part.

9. The magazine of claim 1, wherein when a cartridge remains in the magazine, the cartridge is operable to hold the second follower in the lower retracted position.

10. A magazine for storing and dispensing cartridges to a firearm, the magazine comprising:

an elongated tubular body defining a longitudinal axis and having a front wall, a rear wall and two opposing sidewalls defining a cavity configured for receiving cartridges;

a compression spring disposed in the cavity;

a first follower moveable within the cavity along the longitudinal axis;

a second follower disposed below the first follower and being movable independently of the first follower, the second follower urged in an upward direction by the compression spring and having a base plate with an upward extending rigid ejection flange configured and dimensioned for insertion through a slot formed in the first follower, the flange having a forward facing vertical contact surface configured for engaging an extracted spent cartridge case or rim and a rearward facing vertical contact surface configured rom slidably engaging a rear surface of the slot;

wherein the second follower is moveable from a lower retracted position in which the flange does not project beyond the slot and an upper projected position in which the flange projects above the slot;

wherein the base plate of the second follower has a length and width and the slot of the first follower has a length and width; and wherein both the length and width of the base plate of the second follower are larger than the length and width of the slot of the first follower.

11. The magazine of claim 10, wherein when the second follower is in the lower retracted position, the entire base plate is spaced vertically apart from the first follower, and when the second follower is in the projected position, the base plate engages the first follower.

12. The magazine of claim 10, wherein the forward facing vertical contact surface of the flange has a height larger than a width of the flange.

13. The magazine of claim 1, wherein the forward facing vertical contact surface and the rearward facing vertical contact surface are slidable through the slot along the longitudinal axis of the magazine.

14. A magazine for storing and dispensing cartridges to a firearm, the magazine comprising:

an elongated tubular body defining a longitudinal axis and having a front wall, a rear wall and two opposing sidewalls defining a cavity configured for receiving cartridges;

a compression spring disposed in the cavity;

a first follower slidably moveable within the cavity along the longitudinal axis, the first follower comprising a cartridge support plate including an upper rear part configured for supporting a cartridge case and a lower front part that lies on a different plane than the upper rear part;

a second follower disposed below the first follower and being movable independently of the first follower, the second follower urged in an upward direction along the longitudinal axis by the compression spring and having a base plate with an upward extending rigid ejection flange configured and dimensioned for slidable insertion through a slot formed in the cartridge support plate of the first follower, the flange having a forward facing vertical contact surface configured for engaging an extracted spent cartridge case or rim and a rearward facing vertical contact surface configured for engaging a rear surface of the slot;

wherein the second follower is moveable from a lower retracted position in which the flange does not project beyond the slot and an upper projected position in which the flange projects above the slot;

wherein the base plate of the second follower has a length and width and the slot of the first follower has a length and width; and wherein both the length and width of the base plate of the second follower are larger than the length and width of the slot of the first follower.

15. The magazine of claim 14, wherein the slot is formed in the upper part of the cartridge support plate.

16. The magazine of claim 14, wherein the base plate of the second follower has a length and width and the slot of the first follower has a length and a width, at least one of the length or width of the base plate being larger than at least one of the length or width of the slot to prevent the second follower from being ejected through the slot. I.

17. A firearm with a magazine for storing and dispensing cartridges, the firearm comprising:

a frame;

a slide slidably mounted on the firearm for forward and rearward reciprocating axial movement, the slide forming an openable and breech face;

a barrel supported by the frame and including a chamber configured for holding a cartridge, the barrel defining a cartridge extraction pathway between the chamber and the breech face of the slide;

a magazine comprising an elongated tubular body defining a longitudinal axis and a cavity configured for receiving cartridges;

a compression spring disposed in the cavity;

a first follower moveable within the cavity;

a second follower disposed within the cavity below the first follower and being movable independently of the first follower, the second follower urged in an upward direction along the longitudinal axis by the compression spring and having a base plate with an upward extending rigid ejection flange configured and dimensioned for slidable insertion through a slot formed in the first follower;

wherein the second follower is moveable from a lower retracted position in which the flange does not project beyond the slot and an upper projected position in which the flange projects above the slot into the cartridge extraction pathway to engage a spent cartridge case extracted from the chamber for ejection from the firearm;

wherein the base plate of the second follower has a length and width and the slot of the first follower has a length and width; and wherein both the length and width of the base plate of the second follower are larger than the length and width of the slot of the first follower.

* * * * *